US006799343B1

(12) United States Patent
Pardue

(10) Patent No.: US 6,799,343 B1
(45) Date of Patent: Oct. 5, 2004

(54) RECLINING CUSHION

(76) Inventor: Chris L. Pardue, 245 College Park Rd., Lexington, NC (US) 27295

( * ) Notice: Subject to any disclaimer, the term of this patent is extended or adjusted under 35 U.S.C. 154(b) by 0 days.

(21) Appl. No.: 10/317,349

(22) Filed: Dec. 12, 2002

(51) Int. Cl.[7] ..... A47C 20/00
(52) U.S. Cl. ..... 5/632; 5/648
(58) Field of Search ..... 5/632, 631, 634, 5/640, 648, 722, 657

(56) References Cited

U.S. PATENT DOCUMENTS 2,149,140 A * 2/1939 Gonzalez-Rincones ..... 5/632
4,218,792 A 8/1980 Kogan
4,754,510 A * 7/1988 King ..... 5/632
4,832,007 A 5/1989 Davis, Jr. et al.
5,519,907 A 5/1996 Poths
5,533,218 A 7/1996 Fahy
5,628,633 A 5/1997 Lehman
6,349,437 B1 * 2/2002 Horning ..... 5/632
6,360,388 B2 3/2002 Langer
6,412,128 B1 7/2002 Matthews
6,471,726 B2 10/2002 Wang

* cited by examiner

*Primary Examiner*—Teri Pham Luu
*Assistant Examiner*—Fredrick Conley

(57) ABSTRACT

A cushion for use while reclining is provided having a first section for placement against the chest and a second section for placement between the legs. The first and second sections are longitudinally aligned, though rotated at an approximate ninety degree angle. The cushion is formed from a suitable polymeric foam such as polyurethane by molding, machining or the like.

15 Claims, 3 Drawing Sheets

RECLINING CUSHION

FIELD OF THE INVENTION

This invention pertains to cushions as use for resting and particularly pertains to a cushion for use while the user is reclining on his/her side to support the upper arm by a first cushion vertical section while the upper leg is supported by a second cushion horizontal section.

DESCRIPTION OF THE PRIOR ART AND OBJECTIVES OF THE INVENTION

In recent years cushion manufacturers have devised various designs and shapes to provide comfort to users as they rest or sleep in a reclining position. Much attention has been paid to separating the legs of the user to better align the hips with the spinal column while the user is sleeping on one side. It has also been found in the past that by providing support to the upper arm of the user, side sleeping can be more comfortable and less tossing and turning occurs. However, the use of various body cushions or pillows includes a cushion placed beneath the head. When separate cushions are placed against the body they are often inadvertently separated from the body after a short rest, thus possibly causing the user to awake with an aching muscle and having to recapture the misplaced cushion to resume sleeping. Thus, the use of two body pillows can be a distraction while attempting to sleep since one or both pillows will often inadvertently migrate from the user.

Hence, with the disadvantages and problems associated with prior cushions while reclining, the present invention was conceived and one of its objectives is to provide a single reclining cushion which will accommodate both the arms and the legs of the user.

It is still another objective of the present invention to provide a cushion made from a resilient polymeric material which is lightweight and relatively inexpensive.

It is yet another objective of the present invention to provide a cushion which is useful while reclining having both a first section for placement against the users chest or upper body and a second section for placement between the legs.

It is still another objective of the present invention to provide a reclining cushion with first and second sections that are integrally formed at an approximate ninety degree angle to each other.

Various other objectives and advantages of the present invention will become apparent to those skilled in the art as a more detailed description is set forth below.

SUMMARY OF THE INVENTION

A cushion is presented for use by a person reclining on one side formed such as by molding from a thick, resilient polymeric substance such as polyurethane foam. The reclining cushion is formed such as by molding a first section for placement against the chest or upper body portion and a second section which is positioned between the legs as the user is on his/her side. The first and second sections are integrally formed with a twisted section between to easily maintain its position against the body of the user during a long night's sleep. The first section of the cushion may have a width of approximately 20 inches (50.8 cm) to accommodate an average size adult with the second section having a similar width. The first and second sections are aligned along a longitudinal axis at an approximate ninety degree angle to each other and are joined to a twisted section therebetween. Thus, as the user lays on his/her side, the upper section is placed against the chest beneath the chin to support the upper arm while the second section is positioned between the legs of the user to separate the legs and to maintain a comfortable pelvic position during sleep.

DETAILED DESCRIPTION OF THE PREFERRED EMBODIMENT AND OPERATION OF THE INVENTION

Figure 1:
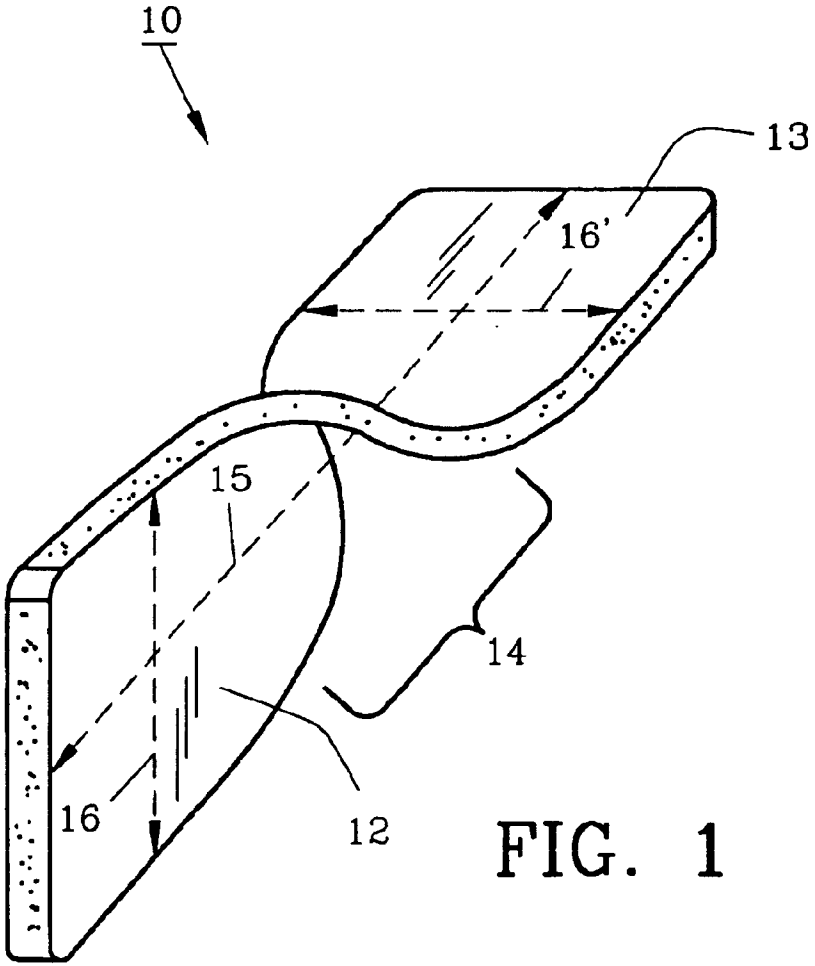
FIG. 1 illustrates a right-side, top front-end perspective view of the preferred embodiment of the invention.

For a better understanding of the invention and its operation, turning now to the drawings, FIG. 1 shows a perspective view of preferred reclining cushion 10 having a body 11 with first section 12 and second section 13 which are disposed at an approximate ninety degree angle to each other through twisted section 14 along longitudinal axis 15. Cushion 10 is preferably formed from a polymeric material such as polyurethane having a suitable density to provide support and durability.

Longitudinal axis 15 provides the major axis for cushion 10 which may be for example 46 inches (116.8 cm.) in length. Minor axis 16 designates the width of first section 12 and extends approximately 20 inches (50.8 cm.) as does minor axis 16' of second section 13. As would be understood, minor axis 16 of section 12 and minor axis 16' of section 13 are perpendicular to longitudinal axis 15. Thus as seen, minor axis 16 of section 12 and minor axis 16' of section 13 are at a ninety degree angle to longitudinal axis 15, which is preferred. However, certain acute or obtuse angles may also provide satisfactory results for the user from 75° to, for example 105°.

Figure 2:
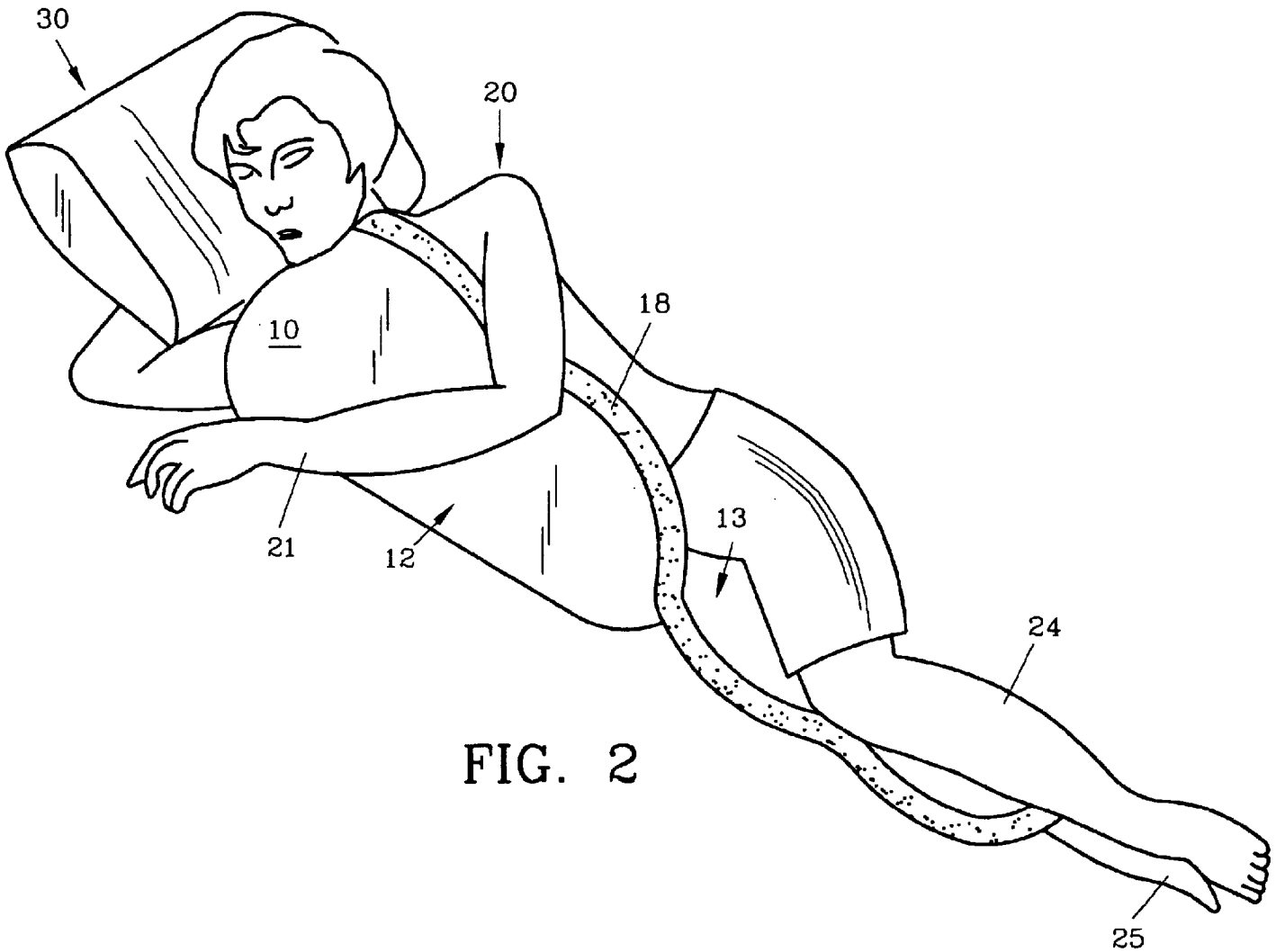
FIG. 2 shows the cushion of FIG. 1 with a user in a reclining position.

As shown in FIG. 2, first section 12 is placed along the chest and upper body of user 20 below the head and while user 20 lays on her right side. First section 12 provides support for left arm 21 of user 20 along side edge 18 which may provide a 5 inch (12.7 cm.) thickness of first section 12 and also for second section 13.

As would be further understood, the preferred dimensions set forth above for reclining cushion 10 would present dimensions for a cushion as used by an average adult having a height of approximately 5'4"–5'10" (162.6–178 cm.). However, other lengths and widths of reclining cushion 10 can be manufactured depending on the particular size of the intended user.

As further shown in FIG. 2, left leg 24 of user 20 is positioned atop second section 13 whereas right leg 25 is positioned beneath second section 13. By thus separating the arms by first section 12 and separating the legs by second section 13, a comfortable, relaxing, reclining position can be obtained.

Figure 4:
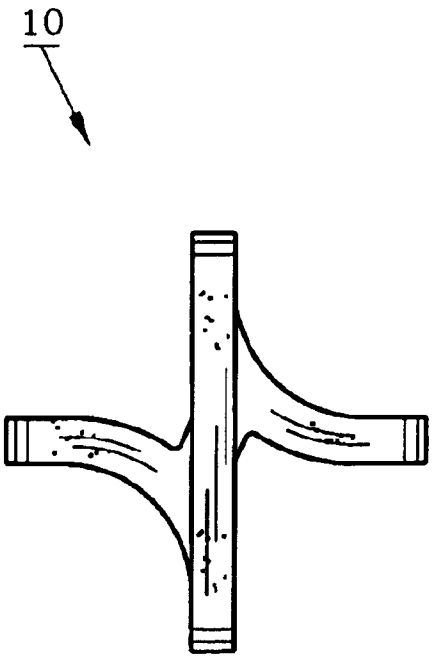
FIG. 4 shows a front-end view of the reclining cushion as shown in FIG. 1, it further being understood that a rear-end view would be a mirror image thereof.
Figure 5:
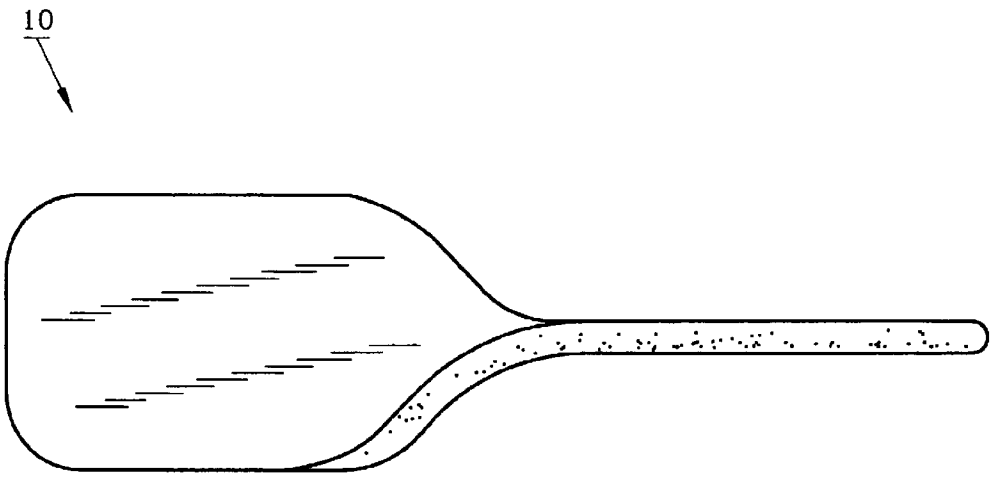
FIG. 5 illustrates a left side elevational view of the cushion as shown in FIG. 1.
Figure 3:
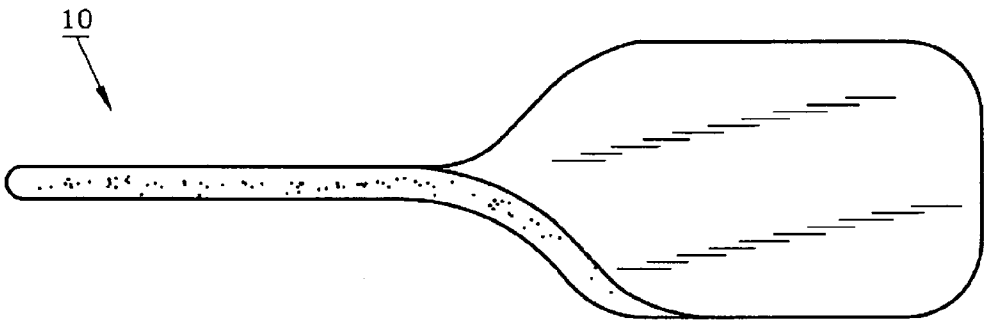
FIG. 3 demonstrates a right side view of the cushion, it being understood that a left side view would be a mirror image thereof.

The top view of reclining cushion 10 is shown in FIG. 3 without a user as are side views seen in FIGS. 4 and 5. It would be understood, the bottom view is substantially a mirror image of that shown in FIG. 3 whereas the rear-end view of reclining cushion 10 would be a mirror image from the front end as shown in FIG. 4. Reclining cushion 10 therefore is symmetrical in all respects.

Reclining cushion 10 can be made in a variety of ways, with the preferred method of manufacturing consisting of forming cushion 10 in a mold using a suitable, conventional polyurethane foam. However, a polyurethane foam block could first be made to suitable dimensions and by machine or laser cutting, reclining cushion 10 could then be configured. Twisted section 14 joins first planar section 12 and second planar section 13 to allow and approximate ninety degree twist.

The method of using reclining cushion 10 includes the steps of placing reclining cushion 10 on a floor, bed or other support, the user then lays on his/her, for example right side, and presses first section 12 against the chest and beneath the chin. Next, the right leg 25 is positioned beneath second section 13 with the left leg 24 placed atop second section 13 as shown in FIG. 2. A standard head pillow 30 as shown in FIG. 2 may also be used in conjunction with reclining cushion 10 for comfort. The user can change to a left side position as desired.

The illustrations and examples provided herein are for explanatory purposes and are not intended to limit the scope of the appended claims.

I claim:

1. A cushion for reclining comprising: a resilient body, said body defining a first section, a second section, and a twisted section said first section angularly disposed to said second section, said twisted section positioned between said first and said second sections.

2. The cushion of claim 1 wherein said first section and said second sections have major and minor axis, each of said section major axis perpendicular to said same section minor axis.

3. The cushion of claim 1 wherein said first section is angularly disposed at an acute angle to said second section.

4. The cushion of claim 1 wherein said first section is angularly disposed at an obtuse angle to said second section.

5. The cushion of claim 1 wherein said first section is angularly disposed at a ninety degree angle to said second section.

6. The cushion of claim 1 formed from polyurethane.

7. The cushion of claim 1 wherein said first, second and twisted sections are integrally formed.

8. The cushion of claim 1 wherein said first section and said second section are approximately the same length.

9. A cushion for placing against the chest and between the legs while reclining comprising: a resilient body, said body including a first section, a second section and a twisted section, said first and second sections aligned along the longitudinal axis of said body, said first section rotated along said longitudinal axis approximately ninety degrees relative to said second section, said twisted section disposed between said first and second sections.

10. The cushion of claim 9 formed from a polymer foam.

11. The cushion of claim 10 wherein said polymer foam comprises polyurethane.

12. The cushion of claim 9 wherein said first and second sections are integrally formed with said twisted section.

13. The cushion of claim 9 formed by molding.

14. The cushion of claim 9 formed by machining.

15. The cushion of claim 9 wherein said first and said second sections have approximately equal lengths and widths.

* * * * *